US011387563B2

(12) United States Patent
Cartaillac

(10) Patent No.: US 11,387,563 B2
(45) Date of Patent: Jul. 12, 2022

(54) RADIOFREQUENCY EXCITER OF A RECEIVING AND TRANSMITTING ANTENNA

(71) Applicant: THALES, Courbevoie (FR)

(72) Inventor: Erwan Cartaillac, Labatut (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 17/251,149

(22) PCT Filed: Jun. 20, 2019

(86) PCT No.: PCT/EP2019/066343
§ 371 (c)(1),
(2) Date: Dec. 10, 2020

(87) PCT Pub. No.: WO2019/243493
PCT Pub. Date: Dec. 26, 2019

(65) Prior Publication Data

US 2021/0257740 A1 Aug. 19, 2021

(30) Foreign Application Priority Data

Jun. 21, 2018 (FR) ..... 1800640

(51) Int. Cl.
*H01Q 13/02* (2006.01)
*H01P 1/17* (2006.01)
(Continued)

(52) U.S. Cl.
CPC ..... *H01Q 13/0241* (2013.01); *H01P 1/173* (2013.01); *H01P 1/2131* (2013.01); *H01Q 13/0233* (2013.01); *H01Q 15/0026* (2013.01)

(58) Field of Classification Search
CPC ..... H01Q 13/0233; H01Q 13/0241; H01Q 15/0026; H01Q 13/02; H01Q 15/00;
(Continued)

(56) References Cited

U.S. PATENT DOCUMENTS 4,228,410 A * 10/1980 Goudey ..... H01P 1/17 343/858
4,395,685 A * 7/1983 Davies ..... H01P 1/173 333/125
(Continued)

FOREIGN PATENT DOCUMENTS

JP 57-159102 A 10/1982

OTHER PUBLICATIONS

Soma, et al., "A high performance mode transducer/polarizer assembly in the 4 and 6 GHz bands", 1974 International IEEE-AP-S Symposium Program & Digest, pp. 387-390, Jun. 10, 1974.

*Primary Examiner* — Tho G Phan
(74) *Attorney, Agent, or Firm* — BakerHostetler

(57) ABSTRACT

A compact radiofrequency driver includes at least one axial port intended to be connected to a radiating antenna, at least one output intended to collect received signals and at least one input intended to transmit signals, comprising first and second septum polarizers and a frequency filter, the second polarizer being connected, via its common port, to a first rectangular port of the first polarizer and the frequency filter being connected to the second rectangular port of the first polarizer and being configured to filter a reception or transmission frequency band, these two bands being different, and wherein at least one of the polarizers is configured to convert a circularly polarized signal received on said axial port of the driver into a linearly polarized signal in a reception frequency band and in that at least a second polarizer is configured to convert a linearly polarized signal transmitted to the driver by the input into a circularly polarized signal in a transmission frequency band.

11 Claims, 7 Drawing Sheets

(51) Int. Cl.
*H01P 1/213* (2006.01)
*H01Q 15/00* (2006.01)

(58) Field of Classification Search
CPC ..... H01P 1/173; H01P 1/21; H01P 1/2131; H01P 1/16; H01P 1/161; H01P 1/17
See application file for complete search history.

(56) References Cited

U.S. PATENT DOCUMENTS

| | | | | |
|---|---|---|---|---|
| 4,847,574 | A | 7/1989 | Gauthier et al. | |
| 6,046,702 | A * | 4/2000 | Curtis | H01Q 13/0258 333/135 |
| 6,507,323 | B1 * | 1/2003 | West | H01Q 13/0241 343/786 |
| 8,125,400 | B2 * | 2/2012 | Bezuidenhout | H01P 1/161 343/781 R |
| 10,044,083 | B2 * | 8/2018 | Haeussler | H01P 1/171 |
| 10,608,342 | B2 * | 3/2020 | Jensen | H01Q 19/17 |
| 2015/0357695 | A1 | 12/2015 | Hagensen | |

* cited by examiner

RADIOFREQUENCY EXCITER OF A RECEIVING AND TRANSMITTING ANTENNA

CROSS-REFERENCE TO RELATED APPLICATIONS

This application is a National Stage of International patent application PCT/EP2019/066343, filed on Jun. 20, 2019, which claims priority to foreign French patent application No. FR 1800640, filed on Jun. 21, 2018, the disclosures of which are incorporated by reference in their entirety.

FIELD OF THE INVENTION

The invention relates to the field of space telecommunications, and more particularly to a radiofrequency (RF) antenna driver for receiving and transmitting circular polarizations.

BACKGROUND

The present invention is applicable to antennas located on board satellites or to antennas located in ground stations, and especially to high-throughput multibeam applications that employ primary FeedFeeds to receive and transmit circular polarizations. A primary antenna Feed conventionally consists of a radiating element, a horn for example, fed by an RF chain essentially comprising an RF driver.

In multi-beam space-telecommunication applications, the RF drivers are conventionally made up of a number of different devices that allow, on the one hand, the polarizations to be separated, then, on the other hand, the transmission and reception frequency bands to be separated. Moreover, in high-throughput applications, the continuing increase in the number of beams to be produced is leading to an increase in the mass of the Feed units (antenna and driver) and causing the mechanical behaviour of satellites to become more critical. In these high-throughput applications, dual-polarization Feeds (i.e. Feeds able to handle both a right circular polarization and a left circular polarization) are normally used both to transmit and to receive. Dual-polarization Feeds, which comprise four ports, use only two thereof when dealing with a single polarization. Loading the unused ports generates an extra cost but also increases the mass of the Feed. In addition, the integration of these loads makes it more difficult to route and integrate the waveguides of the satellite.

In a single-polarization transmit-and-receive application (i.e. one in which either a right circular polarization or a left circular polarization is employed) it is necessary to produce Feeds without such loads to achieve a compact, low-cost design with a low mass. To this end, architectures comprising a septum polarizer have been proposed, but these architectures are limited in terms of bandwidth percent, and hence can only be used for transmit-or-receive applications (single-band applications).

In dual-band applications, i.e. transmit-and-receive applications, complex antenna driver architectures comprising absorbing loads are used. These architectures may for example comprise an orthomode transducer (OMT), an orthomode junction (OMJ), or a septum polarizer. FIGS. 1 to 3 show some of these architectures.

The architecture of FIG. 1 comprises an orthomode junction OMJ that allows the two linear components (horizontal component and vertical component) of a circularly polarized signal to be separated, and a septum polarizer PS that allows a circularly polarized signal to be converted into a linearly polarized signal, and vice versa. The two components of the circularly polarized signal are out of phase by 90°. A horn antenna A is connected to one of the ports of the junction OMJ, whereas the second port of the junction OMJ is connected to the polarizer PS. The polarizer PS comprises three ports: a common port connected to the junction OMJ, and two rectangular ports, called the right port (DRx) and left port (GRx), that form the reception ports of the device. The junction comprises two coupling slots each comprising one frequency filter TF, these slots being connected to a radiofrequency coupler CRF, two of the ends of which form the two transmission ports DTx and GTx of the device.

When the device receives a signal, a circularly polarized signal is delivered to the horn antenna A and then is sent to the junction OMJ. As the frequency filters TF filter the reception frequency band (they let pass only the frequencies of the transmission band) the received signal is passed in its entirety to the septum polarizer PS and is still circularly polarized. The polarizer PS allows the two components to be shifted back into phase, so as to obtain a linearly polarized signal on one of the reception ports DRx or GRx. This device comprises two reception ports, in order to collect the signal received by the antenna regardless of whether its circular polarization is left or right circular polarization.

When the device transmits a signal, a linearly polarized signal, of amplitude A, is output from one of the transmission ports DTx and GTx. The signal first passes through the coupler CRF, which allows the signal to be separated into two signals phase-shifted by 90° and of amplitude A/2, these two signals then passing through the filters TF before reaching the junction OMJ. The junction OMJ will recombine these two signals with a view to sending a circularly polarized signal to the horn antenna A. Depending on the input port DTx or GTx, the signal transmitted by antenna A will be right or left circularly polarized.

This device has a few drawbacks: it possesses many components (eight elementary parts), this leading to a high manufacturing cost, and, for single-polarization applications, it requires two absorbent loads that are expensive to provide, especially because of manufacturing lead times.

The architecture of FIG. 2 comprises an orthomode transducer OMT connected to a 90° polarizer P, itself connected to a horn A. The polarization diplexer OMT in particular allows the two, vertical and horizontal, components of a linearly polarized signal to be generated, one of these polarizations being associated with the transmitted signal and the other with the received signal. On reception, the horn A receives a circularly polarized signal, which is then converted into a linearly polarized signal by virtue of the 90° polarizer P. Next, this signal passes through the diplexer OMT and is collected by the reception port GRx.

On transmission, a linearly polarized signal is transmitted to the diplexer OMT by the transmission port DTx. On exiting the diplexer OMT and on entering the polarizer P, the signal is still linearly polarized and still comprises a vertical component and a horizontal component. The polarizer P introduces a phase shift of 90° between these two components, this allowing a circularly polarized signal to be obtained, which is then transmitted by the horn A. Nevertheless, to generate the circular polarization, the polarizer P uses an oversized cavity for the reception frequency band, this causing higher modes to appear and limiting reception bandwidth. In addition, this architecture may also degrade the radiation performance of the antenna A, especially as regards its carrier-to-interference ratio (or C/I) and its cross-polarization discrimination (or XPD). This architecture is also limited to single-polarization applications.

The architecture of FIG. 3 is more complex than the first architectures, especially as regards the transmission chain, which comprises an orthomode junction OMJ with four coupling slots requiring a recombination with two horizontal plane dividers D and a coupler CRF to generate the circular polarization. This architecture comprises more elementary parts and therefore has many drawbacks with respect to assembly, mass, cost, or bulk. Just like architecture 1, this architecture is used for single-polarization or dual-polarization applications.

SUMMARY OF THE INVENTION

The invention aims to overcome the aforementioned drawbacks and limitations of the prior art. More precisely, it aims to provide a driver allowing the transition from a single-band septum-polarizer architecture to a transmit-and-receive dual-band septum-polarizer architecture. A driver according to the invention has the advantage of not comprising any absorbent loads when it is used in single-polarization mode.

One subject of the invention is therefore a compact radiofrequency driver comprising at least one axial port intended to be connected to a radiating antenna, at least one output intended to collect signals received by said antenna and at least one input intended to transmit signals via said antenna, characterized in that it also comprises a first septum polarizer and a second septum polarizer, and a frequency filter, the two septum polarizers each comprising three ports, one of the ports being a common port and the two other ports being rectangular ports, called the right port and left port, the second septum polarizer being connected, via its common port, to a first rectangular port of the first polarizer and the frequency filter being connected to the second rectangular port of the first polarizer and being configured to filter a reception frequency band or a transmission frequency band, and characterized in that at least one of the polarizers is configured to convert a circularly polarized signal received on said axial port of the driver into a linearly polarized signal in a reception frequency band and in that at least a second polarizer is configured to convert a linearly polarized signal transmitted to said driver by said input into a circularly polarized signal in a transmission frequency band different from said reception frequency band.

According to particular embodiments of the invention:

- the common port of said two polarizers has a square or circular cross section;
- the rectangular ports of said two polarizers have a rectangular or elliptical cross section;
- the radiofrequency driver also comprises a second frequency filter (F3) and a third septum polarizer (PS4), said second filter being connected to one of said rectangular ports of said second polarizer (PS2) and being configured to reject the same frequency band as said first filter (F1), and said third polarizer (PS4) being placed between said first polarizer (PS1) and said first filter (F1), its common port being connected to the first polarizer (PS1) and one of its rectangular ports being connected to the first filter (F1), and the third polarizer (PS4) being configured to convert said circularly polarized signal received on said axial port of the driver into a linearly polarized signal in a reception frequency band or to convert said linearly polarized signal transmitted to said driver by said input into a circularly polarized signal in a transmission frequency band;
- the radiofrequency driver also comprises a second frequency filter and a third septum polarizer, said second filter being connected to said first rectangular port of said first polarizer in parallel with said second polarizer and being configured to reject a reception frequency band or a transmission frequency band, and said third polarizer being connected to said second rectangular port of said first polarizer in parallel with said first frequency filter and being configured to convert said circularly polarized signal received on said axial port of the driver into a linearly polarized signal in a reception frequency band or to convert said linearly polarized signal transmitted to said driver by said input into a circularly polarized signal in a transmission frequency band;
- the radiofrequency driver also comprises a frequency filter placed between one of the rectangular ports of said first polarizer and the common port of said second polarizer or of said third polarizer; and
- the septum of each septum polarizer has a profile chosen from a stepped profile, a profile expressed by a spline curve or a linear profile.

The invention also relates to an antenna characterized in that it comprises at least one compact driver according to one embodiment of the invention.

The invention also relates to a satellite characterized in that it comprises at least one antenna according to one embodiment of the invention.

BRIEF DESCRIPTION OF THE DRAWINGS

Other features, details and advantages of the invention will become apparent upon reading the description with reference to the appended drawings, which are given by way of example and which show, respectively.

DETAILED DESCRIPTION

Figure 1:
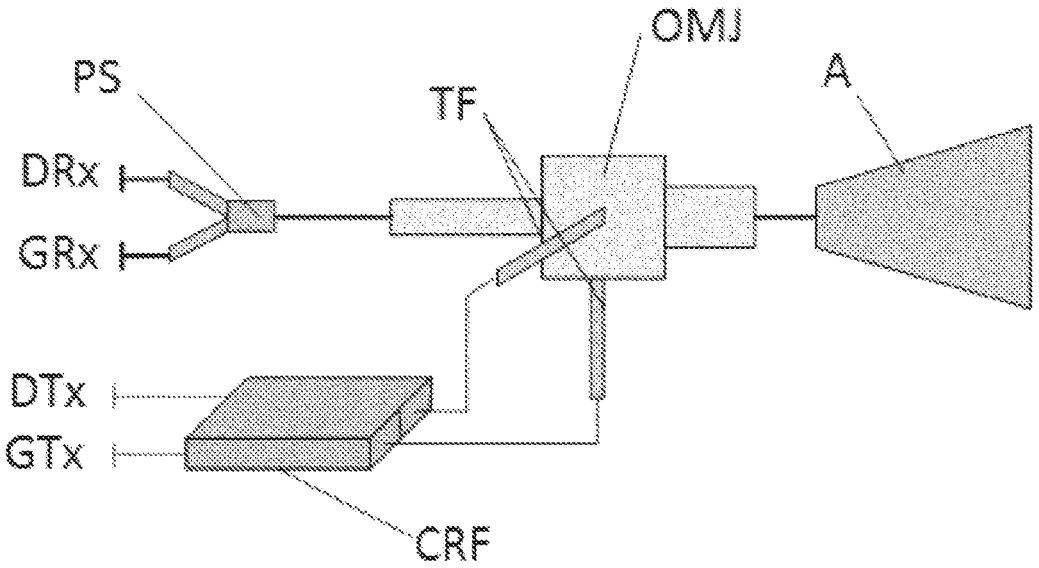
Fig. 1 PRIOR ART
FIGS. 1 to 3, an antenna driver according to the prior art.
Figure 2:
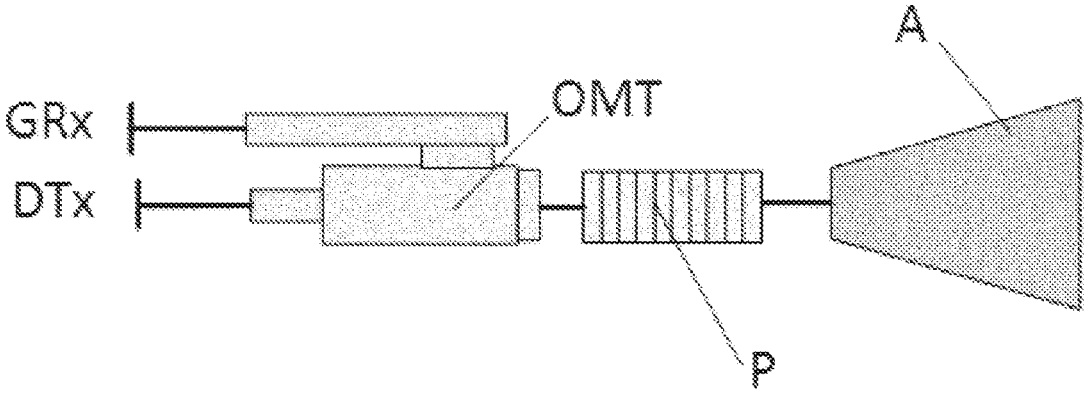
Fig. 2 PRIOR ART
Figure 3:
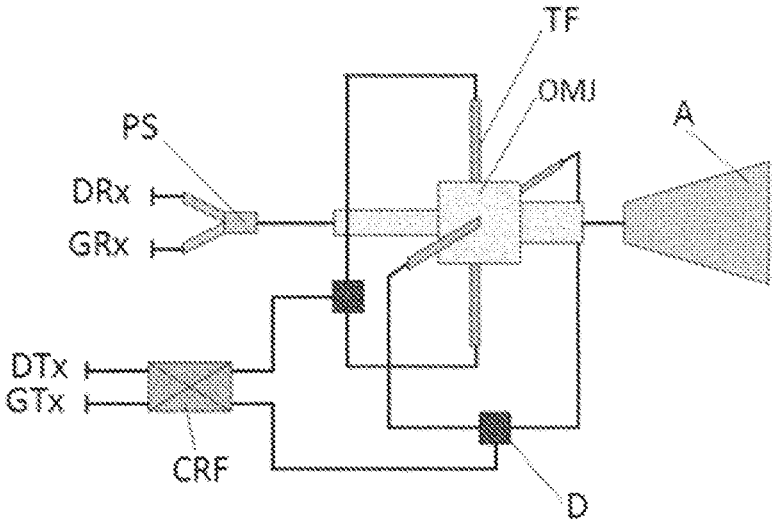
Fig. 3 PRIOR ART
Figure 4A:
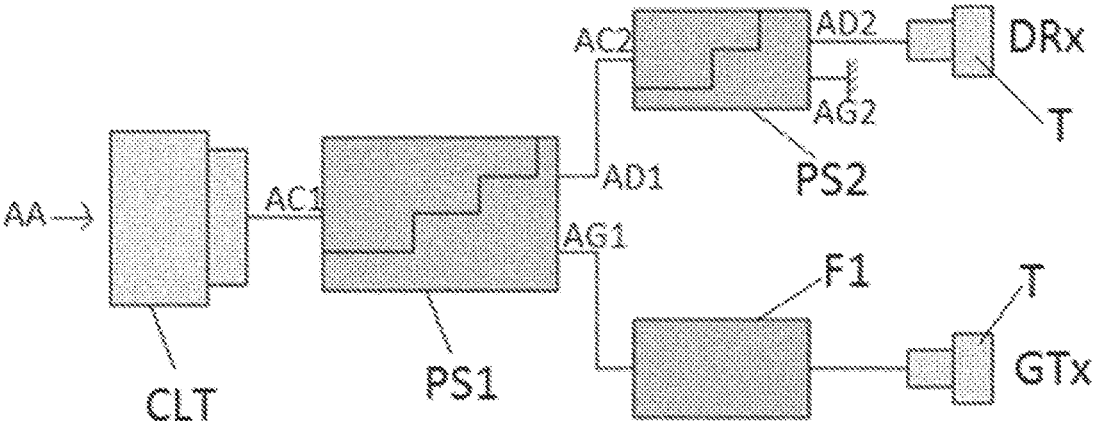
FIG. 4*a*, an antenna driver according to a first embodiment of the invention and FIGS. 4*b* to 4*e*, an antenna driver according to variants of this first embodiment.

FIG. 4*a* shows a driver according to a first embodiment of the invention. This first embodiment corresponds to a single-polarization application. The ports DRx and GTx define the transmission port (GTx) and reception port (DRx) of the device. The latter comprises two septum polarizers PS1 and PS2 placed in cascade, and a frequency filter F1.

The two septum polarizers each possess three ports: a common port and two rectangular ports, called the right and left ports. A waveguide CLT is connected to the first polarizer PS1 via its common port AC1 and the second polarizer PS2 is connected to the right port AD1 of the first polarizer PS1 via its common port AC2. Lastly, the left port AG1 of the first polarizer PS1 is connected to a frequency filter F1. The filter F1 may be connected to this port AG1 directly (case of FIG. 4*a*) or indirectly and for example by virtue of another septum polarizer (case of FIG. 6). The filter F1 is then optionally connected to a waveguide taper T or to a "stepped transition" and forms the transmission port GTx of the device. The right port AD2 of the second polarizer is optionally connected to a taper T and forms the reception port DRx. The left port AG2 of the second polarizer PS2 is in this example connected to ground.

In this example, the filter F1 lets pass only the transmission frequency band and therefore rejects the frequencies of the reception band. The waveguide CLT is, for example, an adapter allowing a component of circular cross section to be connected to a component of square cross section. An antenna, a horn antenna for example, may thus be connected to the first polarizer PS1 by virtue of this waveguide CLT via the port AA. A taper T is a waveguide the input and output of which have different dimensions, this allowing the field passing through it to be increased or decreased.

When a right polarization signal is received by the device by virtue of a horn connected to the waveguide CLT, a right circularly polarized signal is delivered to the first polarizer PS1 via its common port AC1. This circular signal comprises two linear components: a vertical component and a horizontal component. The vertical component is considered to be parallel to the septum (or plate) of the septum polarizer PS1 and the horizontal component is considered to be perpendicular to the septum (or plate) of the polarizer PS1. The parallel component of the signal enters via the common port AC1 into the polarizer PS1, and leaves the polarizer PS1 via the rectangular port AD1, the port AG1 being provided for the left polarization signal. For the parallel component, the cut-off frequency of the polarizer PS1 is modified by the septum of the polarizer PS1, this causing, for the parallel component, a modification of the dispersion within the polarizer PS1. The septum, and more particularly the profile of the plates of the septum, is configured so that the wavelength of this component is shorter than that of the perpendicular component. The parallel component therefore takes more time to travel through the polarizer than the perpendicular component, and is therefore delayed with respect to the perpendicular component by a phase shift of $\phi_{R\text{-}PS1}$ on exiting the rectangular port AD1 of the first polarizer PS1. The signal therefore emerges elliptically polarized from the rectangular port of the polarizer PS1.

The frequency filter F1 is configured so as to reject signals that do not belong to the transmission frequency band, and the signal at the port AG1 of the first polarizer due to decoupling from the right port AD1 is therefore sent back to the polarizer PS1, and more particularly to the second rectangular port AD1. This is possible because the short-circuit plane of the filter F1 is positioned so as to put said signal back in phase.

Via the second rectangular port AD1 of the first polarizer PS1, the signal passes into the second septum polarizer PS2, a phase shift $\phi_{R\text{-}PS2}$ between the vertical component (i.e. parallel to the septum) and horizontal component (i.e. perpendicular to the septum) being generated therein. Now, said polarizer, and in particular the profile of the plates of the septum of the polarizer PS2, is configured so that the elliptically polarized signal emerges linearly polarized. The signal is collected almost entirely by the right port AD2 of the second polarizer PS2 by virtue of a decoupling function that is naturally generated by the plates from which the septum of the first polarizer is formed. The sum of the two phase shifts $\phi_{R\text{-}PS1} \pm \phi_{R\text{-}PS2}$ is equal to 90°, and this sum applied by the two polarizers PS1 and PS2 allows a linearly polarized signal to be obtained on the reception port DRx.

When the device transmits, it transmits a left polarization signal (inverse of the polarization used on reception), and to this end a linearly polarized signal is sent to the device via the port GTx. This signal first passes through filter F1, then on exiting the filter, it is sent to the first polarizer PS1. On exiting the first polarizer PS1 via its common port AC1, the transmitted signal is circularly polarized with a phase shift $\phi_{R\text{-}PS1}$ of 90° then is sent to an antenna connected to the waveguide CLT.

In this example, the first polarizer PS1, and more particularly the profile of the plates of the septum of the polarizer PS1, is configured to convert a linearly polarized signal into a circularly polarized signal during transmission, i.e. it is configured to create a phase shift of 90° between the two, horizontal and vertical, components of a signal entering the device via the transmission port GTx. As the first polarizer PS1 is configured for transmission, it induces a phase shift, of as close to 90° as possible, on the horizontal and vertical components of a signal received on its common port AC1. The second polarizer PS2 is therefore configured so that the sum of the phase shift induced by the first polarizer PS1 and of the phase shift induced by the second polarizer PS2 is 90° for received signals, this allowing a linearly polarized signal to be output from the right port AD2 of the second polarizer PS2.

It is possible to adjust the phase shift between the horizontal and vertical components of the signals, and therefore the polarization between a signal entering and exiting a septum polarizer, by virtue of the number of steps present in the septum of the two polarizers PS1 and PS2, in the case where the septum of the two polarizers has a stepped profile (FIG. 6*a*). Numerical simulations are for example carried out, to adjust the number thereof. In addition, the purity of the circular polarization is characterized by the degree of ellipticity. The latter depends on the phase tolerance with respect to the theoretical phase shift of 90°. For example, it is considered to be possible, with a tolerance of plus or minus 7°, i.e. a phase shift comprised between 83' and 97°, to generate a circular polarization from a linear polarization, and vice versa. Advantageously, the tolerance is plus or minus 2°.

More generally, the phase shift induced by a septum polarizer may be adjusted by modifying the profile of the plates of the septum. This adjustment is generally made by virtue of numerical simulations in which the profile of the plates of the septum is varied (number of steps, linear or curved profile, etc.) in order to obtain the desired phase shift. Thus, in the example of FIG. 4*a*, the profile of the septum of the first polarizer PS1 is configured so that the phase shift between a signal received on the rectangular port AG1 and output via the common port AC1 is 90°±7° in a transmission frequency band. The profile of the septa of the first polarizer PS1 and second polarizer PS2 is also configured so that the phase shift between a signal received on the common port AC1 of the first polarizer PS1 and output via the rectangular port AD2 of the second polarizer PS2 is 90°±7° in a reception frequency band.

Figure 4B:
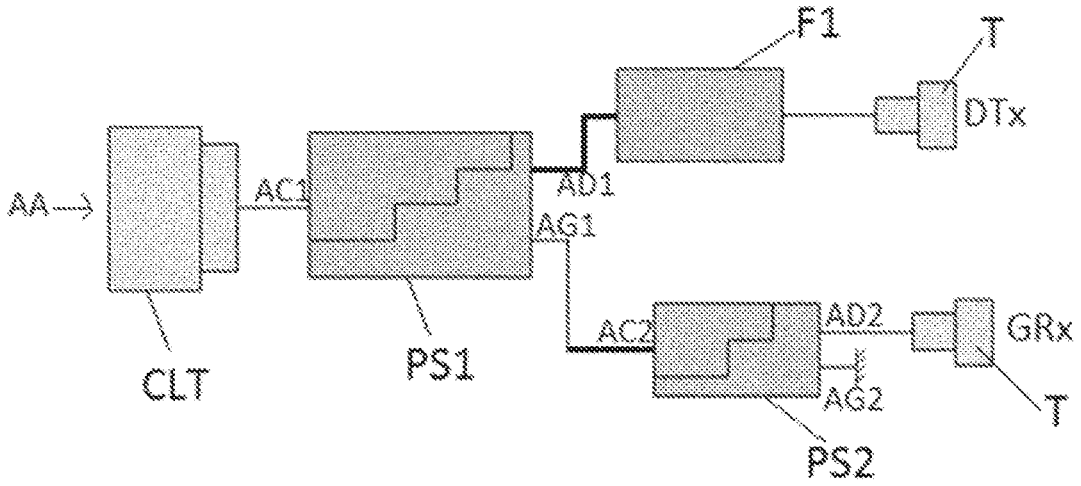

According to another embodiment of the invention, the second polarizer PS2 is connected to the first polarizer PS1 via its left port AG1, and the filter F1 is connected to the first polarizer PS1 via its right port AD1 (FIG. 4*b*). In this case, the reception port GRx is still connected to one of the rectangular ports of the second polarizer PS2, and the transmission port DTx to the filter F1. In this embodiment, the profile of the septum of the first polarizer PS1 is configured so that the phase shift between a signal received on the rectangular port AD1 and output via the common port AC1 is 90°±7° in a transmission frequency band. The profile of the septa of the first polarizer PS1 and second polarizer PS2 is also configured so that the phase shift between a signal received on the common port AC1 of the first polarizer PS1 and output via the rectangular port AD2 of the second polarizer PS2 is 90°±7° in a reception frequency band.

Figure 4C:
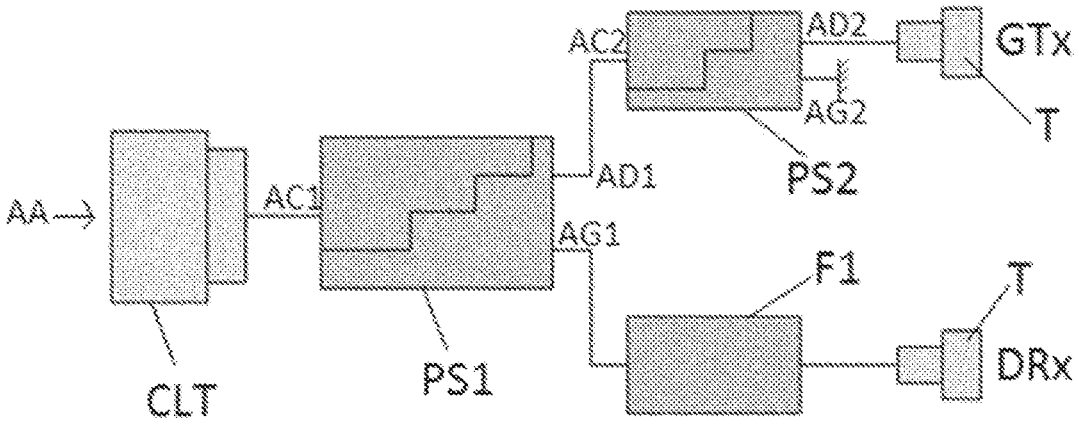

According to another embodiment of the invention, the filter F1 is a filter that rejects the frequencies of the transmission band. In this case, the first polarizer PS1 is configured to obtain a phase shift of 90°, with for example a tolerance of ±7°, between the vertical component and the horizontal component of received signals and the second polarizer PS2 is configured so that the sum of the phase shift induced by the first polarizer PS1 and the phase shift induced by the second polarizer PS2 is 90°, with for example a tolerance of 7°, between the two components of transmitted signals. The phase shift introduced by the two polarizers PS1 and PS2 thus allows the received circularly polarized signal to be converted into a linearly polarized signal and the transmitted linearly polarized signal to be converted into a circularly polarized signal. The receiving port GRx is therefore located on the output of the filter F1 and the transmission port DTx is located on one of the rectangular ports of the second polarizer PS2 (FIG. 4*c*).

In other words, in this embodiment, the profile of the septum of the first polarizer PS1 is configured so that the phase shift between a signal received on the common port AC1 and output via the rectangular port AG1 is 90°±7° in a reception frequency band. The profile of the septa of the first polarizer PS1 and second polarizer PS2 is also configured so that the phase shift between a signal received on the rectangular port AD2 of the second polarizer PS1 and output via the common port AC1 of the first polarizer PS1 is 90°±7° in a transmission frequency band.

According to another embodiment of the invention, a second frequency filter may be placed between the two polarizers PS1 and PS2 so as:

- to reject signals belonging to the transmission frequency band, if the first polarizer PS1 is configured to obtain a phase shift of 90°, with for example a tolerance of ±7°, for transmitted signals and to convert a transmitted linearly polarized signal into a circularly polarized signal (FIG. 4*d*)—in this case, the transmission port GTx is connected to the output of the filter F1 and the reception port DRx is connected to one of the rectangular ports of the second polarizer PS2; or
- to reject signals belonging to the reception frequency band, if the first polarizer PS1 is configured to obtain a phase shift of 90°, with for example a tolerance of ±7°, for received signals and to convert a received circularly polarized signal into a linearly polarized signal (FIG. 4*e*)—in this case, the transmission port DTx is connected to one of the rectangular ports of the second polarizer PS2 and the reception port GRx is connected to the output of the filter F1.

Figure 4D:
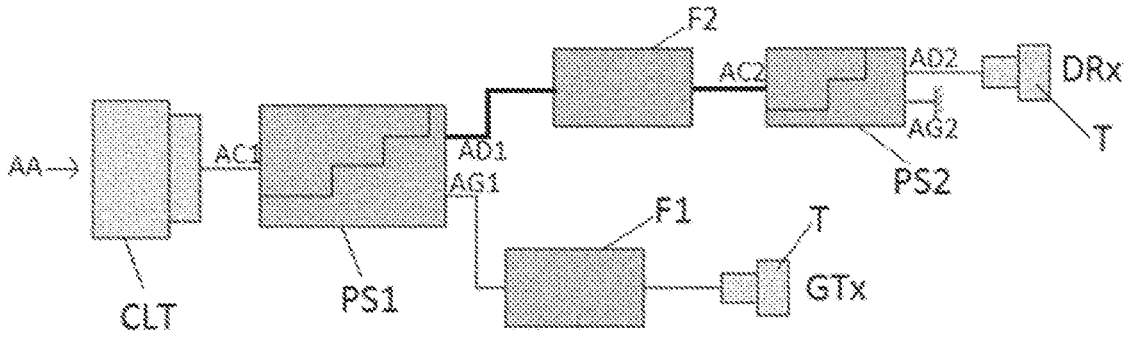

In the example of FIG. 4*d*, the profile of the septum of the first polarizer PS1 is configured so that the phase shift between a signal received on the rectangular port AG1 and output via the common port AC1 is 90°±7° in a transmission frequency band. The profile of the septa of the first polarizer PS1 and second polarizer PS2 is also configured so that the phase shift between a signal received on the common port AC1 of the first polarizer PS1 and output via the rectangular port AD2 of the second polarizer PS2 is 90°±7° in a reception frequency band.

Figure 4E:
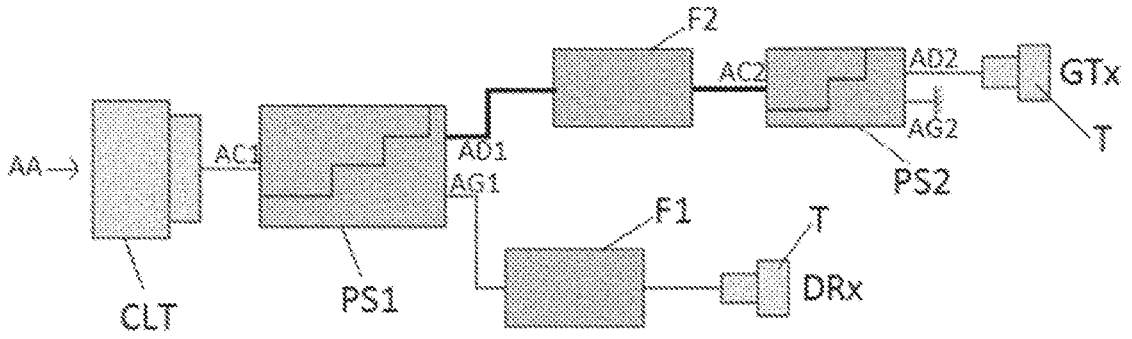

In the example of FIG. 4*e*, the profile of the septum of the first polarizer PS1 is configured so that the phase shift between a signal received on the common port AC1 and output via the rectangular port AG1 is 90°±7° in a reception frequency band. The profile of the septa of the first polarizer PS1 and second polarizer PS2 is also configured so that the phase shift between a signal received on the rectangular port AD2 of the second polarizer PS1 and output via the common port AC1 of the first polarizer PS1 is 90°±7° in a transmission frequency band.

The architecture illustrated in FIGS. 4*a* to 4*e* is dedicated to single-polarization applications, this meaning that, on the reception port DRx, the received signal issued from the right circular polarization will not be collected. To collect the received signal issued from the left circular polarization, the reception port would have to be placed on the second rectangular port of the polarizer PS2.

Figure 5:
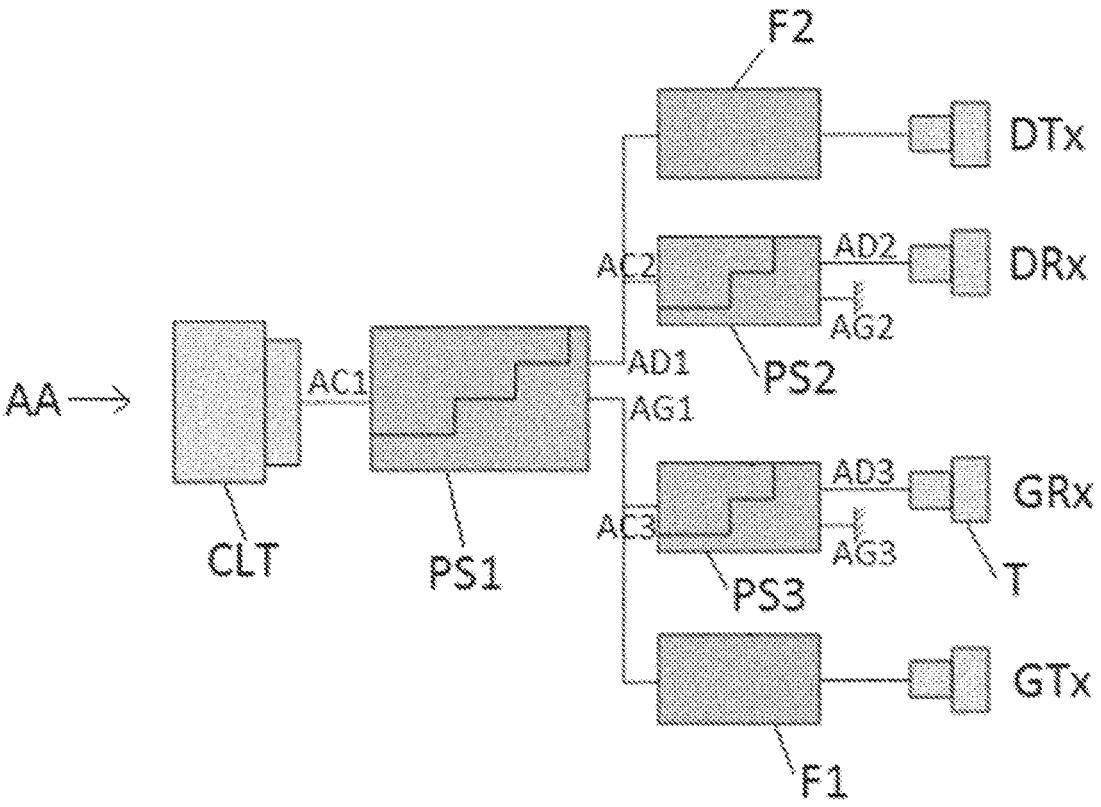
FIG. 5, an antenna driver according to a second embodiment of the invention.

FIG. 5 shows a driver according to a second embodiment of the invention. This architecture is dedicated to dual-polarization applications, and it allows a Feed with four ports, namely two transmission ports GTx and DTx and two reception ports GRx and DRx, to be produced. Compared to the driver of FIG. 4, this driver additionally comprises a second frequency filter F2 placed in parallel with the second polarizer PS2 on the right rectangular port AD1 of the first polarizer PS1; and a third septum polarizer PS3, placed in parallel with the filter F1 on the left port AG1 of the first polarizer PS1.

The operating principle is similar to that of FIG. 4. On transmission, the transmitted signal is delivered to the input of the device via the transmission ports GTx and DTx. This signal is linearly polarized and comprises a vertical component and a horizontal component. The two filters F1 and F2 are configured to reject signals not comprised in the transmission frequency band. The transmitted signal is therefore sent to the first polarizer PS1 via its two rectangular ports AD1 and AG1. The polarizer PS1 (in particular its septum) is configured so as to phase shift by 90°, with for example a tolerance of ±7°, the two components of the transmitted signal in order to convert the linearly polarized signal into a circularly polarized signal. The transmitted signal output from the first polarizer PS1 via its common port AC1 is therefore circularly polarized.

On reception, the received signal is delivered as input to the first polarizer PS1 via its common port AC1. The input signal is circularly polarized. On exiting the polarizer PS1, this signal is left and/or right elliptically polarized, and exits via the left port AG1 and right port AD1 of the first polarizer PS1. It is then sent to the common ports AC2 and AC3 of the two polarizers PS2 and PS3. The polarizers PS2 and PS3, and in particular their respective septum, are configured so that the phase shift induced by the first polarizer PS1 and by the polarizer PS2 or PS3 is 90° between the horizontal and vertical components of the received signal, with a tolerance of ±7°. This allows two linearly polarized signals to be obtained as output from the polarizers PS2 and PS3, on the ports AD2 and AD3, one of these signals resulting from the received left circularly polarized signal and the second resulting from the received right circularly polarized signal.

As above, it is possible for the polarizer PS2 and the filter F2 to be on the left port AG1 of the first polarizer PS1, and for the polarizer PS3 and the filter F1 to be on the right port AD1 of the first polarizer PS1. Likewise, according to another embodiment of the invention, the first polarizer PS1 may be configured so that the phase shift between the two, vertical and horizontal, components of received signals is 90°, with for example a tolerance of ±7° (i.e. to convert a received circularly polarized signal into a linearly polarized signal), the filters F1 and F2 may be configured to reject frequencies not belonging to the reception frequency band, and the polarizers PS2 and PS3 may be configured so that the phase shift between the two components of transmitted signals, i.e. the phase shift induced by the two polarizers PS1 and PS2 or PS1 and PS3, is 90°, with for example a tolerance of ±7° (i.e. to convert a linearly polarized transmitted signal into a circularly polarized signal).

Figure 6:
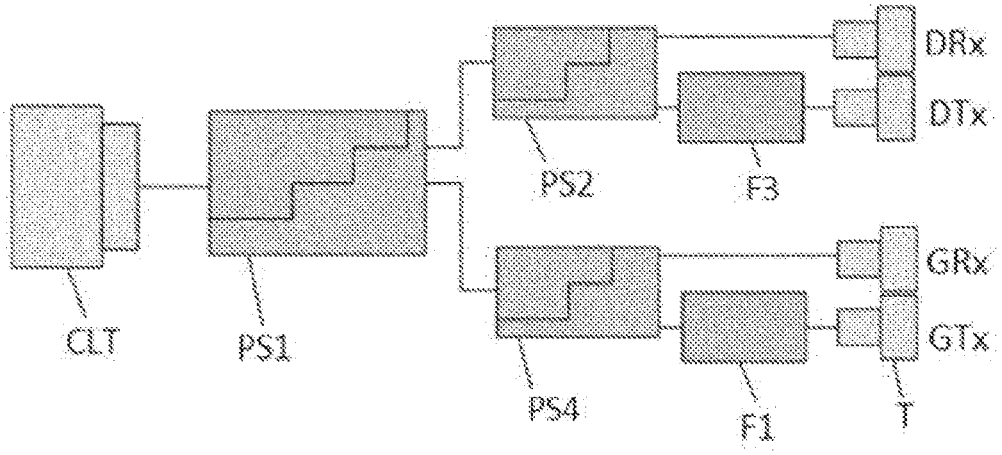
FIG. 6, an antenna driver according to a third embodiment of the invention.

FIG. 6 shows a driver according to a third embodiment. This architecture has four ports: a right reception port DRx, a left reception port GRx, a right transmission port DTx and a left transmission port GTx. This driver comprises three polarizers PS1, PS2 and PS4 and two filters F1 and F3. Compared to the previous architecture, the filters F1 and F3 are each placed at the output of one of the rectangular ports of the polarizers (PS2 for F3 and PS4 for F1). The filters F1 and F3 are for example configured so as to let pass only the frequencies of the transmission band. In this case, the polarizer PS1 generates, in the transmission band, the entire 90° phase shift. The phase shift in the reception band is then either generated, for right received signals, by the combination of the polarizers PS1 and PS2, or, for left received signals, by the combination of the polarizers PS1 and PS4. The polarizers PS2 and PS4 are also, in this example, dimensioned so that the transmitted signal is able to propagate in the plane perpendicular to the septum of PS2 and PS4, but unable to propagate in the plane parallel to the septum. The polarizers PS2 and PS4 are then equivalent to rectangular guides in the transmission band. The transmission and reception bands are filtered via the filters F1 and F3 so that the frequencies of the reception band do not pass to the transmission ports DTx and GTx and via a sub-cutoff guide so that the frequencies of the transmission band do not pass to the reception ports DRx and GRx.

Figure 7A:
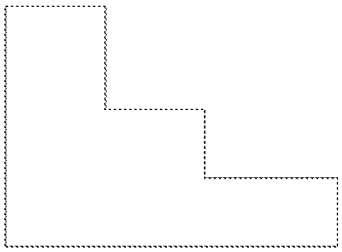
FIGS. 7*a*, 7*b* and 7*c*, the profile of septum-polarizer plates able to be used in various embodiments of the invention.
Figure 7B:
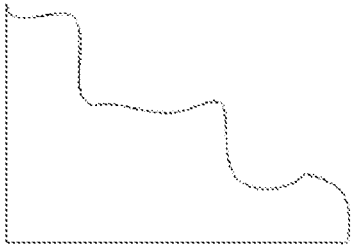
Figure 7C:
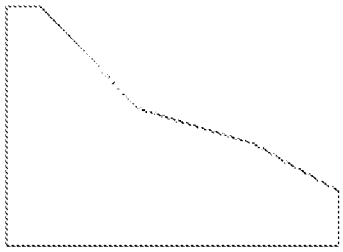

FIGS. 7*a*, 7*b* and 7*c* show the profile of the plates of a septum polarizer present in an antenna driver according to one embodiment of the invention. The plates may have a stepped profile (FIG. 7*a*), a profile given by a spline curve (FIG. 7*b*) or a linear profile (FIG. 7*c*). Regarding a profile given by a spline curve, it is possible to adjust the phase shift of the polarizer by varying the number of points, or knots, interpolated by the curve. For a linear profile, the phase shift may be adjusted by varying the number of sections (or segments) and their slope. The plate profile used will depend on the manufacturing technology. For example, a stepped profile will be preferred when manufacturing by machining, whereas a linear or spline profile will be preferred for additive manufacturing.

Figure 8:
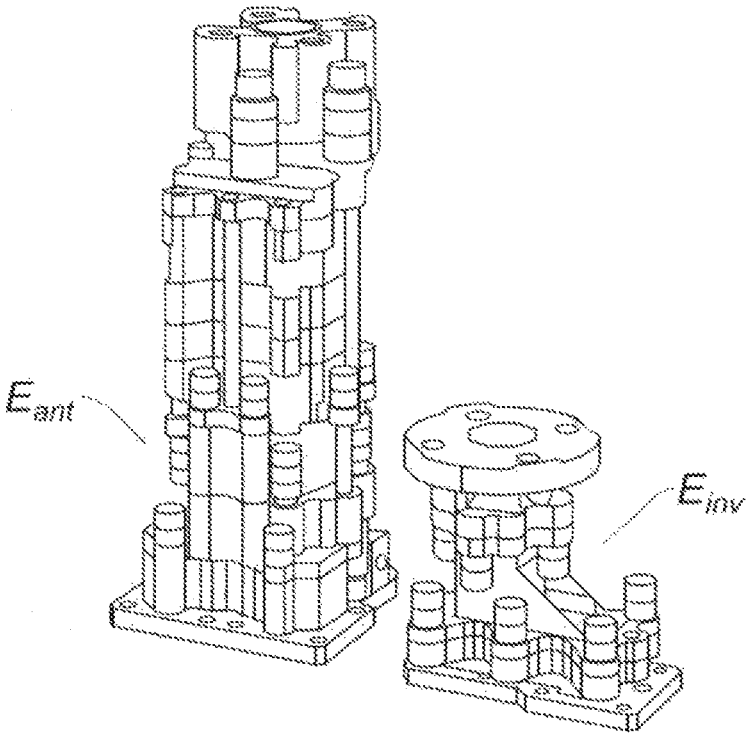
FIG. 8, a comparison between a driver according to the prior art and a driver according to one embodiment of the invention.

FIG. 8 compares a driver according to the prior art $E_{ant}$ and a driver according to one embodiment of the invention $E_{inv}$ in a dual-polarization application. The mass of the driver according to the invention is up to 77% lower than in the prior art and its manufacturing cost is up to 82% lower.

Figure 9:
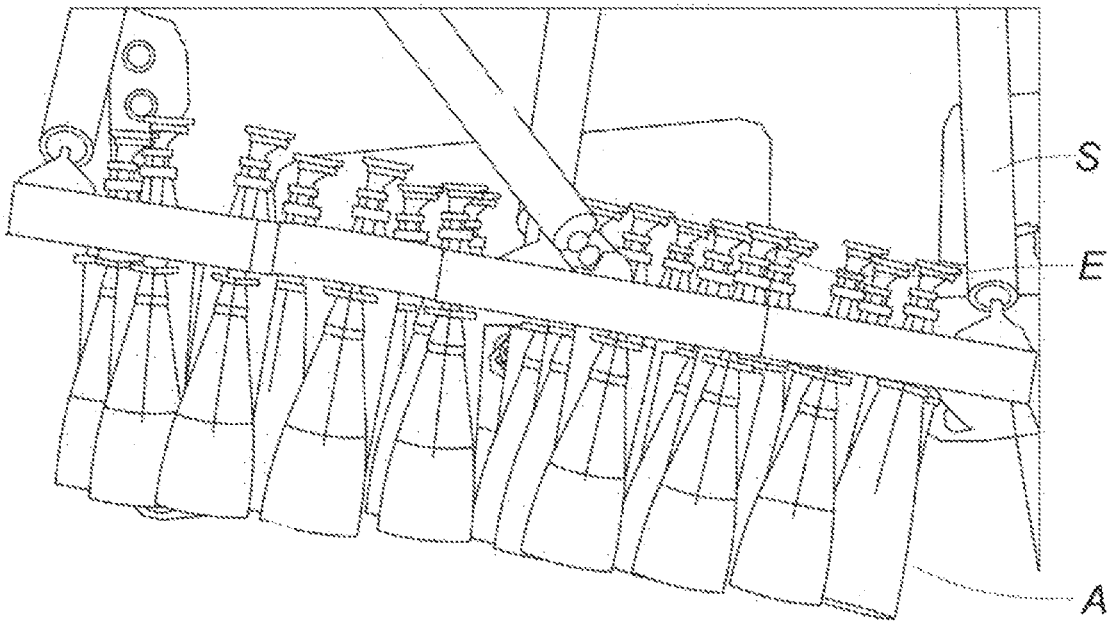
FIG. 9, a satellite including a driver according to an embodiment of the invention.

FIG. 9 shows a satellite S comprising a plurality of horn antennas A on which a driver E according to the invention is placed. In this example, compared to a prior-art driver, mass is lower by about thirty kilograms.

The invention claimed is:

1. A compact radiofrequency driver comprising at least one axial port (AA) intended to be connected to a radiating antenna, at least one output (DRx, GRx) intended to collect signals received by said antenna and at least one input (DTx, GTx) intended to transmit signals via said antenna, further comprising:

a first septum polarizer (PS1);

a second septum polarizer (PS2); and a first frequency filter (F1), the two septum polarizers each comprising three ports, one of the ports being a common port (AC1, AC2) and the other two ports, being a right port (AD1, AD2) and a left port (AG1, AG2), each of the common port, left port, and right port being rectangular ports (AD1, AD2, AG1, AG2), the second septum polarizer being connected via its common port to a first rectangular port of the first polarizer and the frequency filter being connected to the second rectangular port of the first polarizer and being configured to filter a reception frequency band or a transmission frequency band, the axial port being connected to the common port of the first polarizer, the input and the output being connected to the filter or to a rectangular port of the second polarizer, and wherein the septum of the first polarizer (PS1) is configured to convert, in a transmission frequency band, a linearly polarized signal received on one of its rectangular ports (AD1, AG1) into an elliptically polarized signal received on its common port (AC1), and to preserve, in a reception frequency band different from said transmission frequency band, an elliptical polarization between the elliptically polarized signal received on its common port (AC1) and the signal output from its rectangular ports (AD1, AG1).

2. The radiofrequency driver as claimed in claim 1, wherein the septum of the first polarizer is configured so that a phase shift between a signal received on one of its rectangular ports (AD1, AG1) and a signal output from its common port (AC1), in a transmission frequency band, is 90°±7° and the septa of the first and second polarizers are configured so that a phase shift between a signal received on the common port (AC1) of the first polarizer (PS1) and a signal output from one of the rectangular ports (AD2, AG2) of the second polarizer (PS2), in a reception frequency band, is 90°±7°.

3. The radiofrequency driver as claimed in claim 1, wherein the septum of the first polarizer is configured so that a phase shift between a signal received on its common port (AC1) and a signal output from one of its rectangular ports (AD1, AG1), in a reception frequency band, is 90°±7° and the septa of the first and second polarizers are configured so that a phase shift between a signal received on one of the rectangular ports (AD2, AG2) of the second polarizer (PS2) and a signal output from the common port (AC1) of the first polarizer (PS1), in a transmission frequency band, is 90°±7°.

4. The radiofrequency driver as claimed in claim 1, wherein the common port of said two polarizers has a square or circular cross section.

5. The radiofrequency driver as claimed in claim 1, wherein the rectangular ports of said two polarizers have a rectangular or elliptical cross section.

6. The radiofrequency driver as claimed in claim 1, comprising a second frequency filter (F2) and a third septum polarizer (PS3), said second filter being connected to said first rectangular port (AD1) of said first polarizer in parallel with said second polarizer (PS2) and being configured to reject a reception frequency band or a transmission frequency band, and said third septum polarizer (PS3) being connected to said second rectangular port (AG1) of said first polarizer in parallel with said first frequency filter (F1) and being configured to convert a circularly polarized signal received on said axial port (AA) of the driver into a linearly polarized signal in a reception frequency band or to convert said linearly polarized signal transmitted to said driver by said input into a circularly polarized signal in a transmission frequency band.

7. The radiofrequency driver as claimed in claim 6, wherein the second frequency filter (F2) is placed between one of the rectangular ports of said first polarizer (AD1) and the common port of said second polarizer (AC2) or of said third septum polarizer (AC3).

8. The radiofrequency driver as claimed in claim 6, comprising a second frequency filter (F3) and a fourth septum polarizer (PS4), said second filter being connected to one of said rectangular ports of said second polarizer (PS2) and being configured to reject the same frequency band as said first frequency filter (F1), and said fourth polarizer (PS4) being placed between said first polarizer (PS1) and said first frequency filter (F1), its common port being connected to the first polarizer (PS1) and one of its rectangular ports being connected to the first frequency filter (F1), and the fourth polarizer (PS4) being configured to convert said circularly polarized signal received on said axial port of the driver into a linearly polarized signal in a reception frequency band or to convert said linearly polarized signal transmitted to said driver by said input into a circularly polarized signal in a transmission frequency band.

9. The radiofrequency driver as claimed in claim 1, wherein the septum of each said septum polarizer has a profile chosen from a stepped profile, a profile expressed by a spline curve or a linear profile.

10. An antenna, comprising at least one compact driver (Einv) as claimed in claim 1.

11. A satellite, comprising at least one antenna (A) as claimed in claim 10.

* * * * *